US005579962A

United States Patent [19]

Chen

[11] Patent Number: 5,579,962

[45] Date of Patent: Dec. 3, 1996

[54] DECANTER STRUCTURE

[76] Inventor: Chao-Hsing Chen, P.O. Box 96-405, Taipei 10098, Taiwan

[21] Appl. No.: 534,617

[22] Filed: Sep. 27, 1995

[51] Int. Cl.[6] ..... B65D 5/72

[52] U.S. Cl. ..... 222/564

[58] Field of Search ..... 222/478, 479, 222/481, 481.5, 482, 484, 488, 547, 564, 572, 563; 141/286

[56] References Cited

U.S. PATENT DOCUMENTS

| | | | |
|---|---|---|---|
| 1,346,007 | 7/1920 | Aguiao | 222/564 |
| 2,598,403 | 5/1952 | Macey | 222/484 |
| 3,302,833 | 2/1967 | Leika | 222/564 |
| 3,410,459 | 11/1968 | Conley | 222/479 |
| 4,497,422 | 2/1985 | Klees | 222/482 |
| 5,085,355 | 2/1992 | Yoshimura et al. | 222/564 |

*Primary Examiner*—Andres Kashnikow
*Assistant Examiner*—Philippe Derakshani
*Attorney, Agent, or Firm*—Bacon & Thomas

[57] ABSTRACT

An improved decanter structure, which comprises a neck passage, an inner chamber and a partition plate; both sides of the partition plate are thicker than the rest part of the decanter; two symmetrical shoulder passages extend from both sides of the neck passage; the shoulder passages can limit the flow of a liquor upon decanting the liquor, i.e., to provide a buffer effect for controlling the decanting.

1 Claim, 6 Drawing Sheets

DECANTER STRUCTURE

BACKGROUND OF THE INVENTION

1. Field of the Invention

This invention relates to a liquor bottle, and particularly to a decanter which can provide a buffer effect upon decanting a liquor.

2. Description of the Prior Arts

In the conventional liquor bottle, a passage is provided between the neck portion and the inner chamber for filling and decanting a liquor; after the bottle is filled with liquor, the neck passage will be closed with a cork. The neck passage is substantially a straight passage, and it can facilitate filling the bottle with a liquor, but it also has a drawback, i.e., when decanting a liquor out, it is subject to over flowing the liquor in case of the bottle being set at a larger angle.

SUMMARY OF THE INVENTION

The prime object of the present invention is to provide an improved decanter structure, in which the shoulder portion is furnished with two symmetrical passages for limiting the flow upon decanting a liquor out, i.e., to provide a buffer effect for controlling the flow of liquor.

Another object of the present invention is to provide an improved decanter structure, in which a partition plate is furnished between the inner chamber and the neck passage for partitioning the inner chamber and a passage. Inside the shoulder portion, there are two symmetrical shoulder passages in communication with the top surface of the partition plate and the inner chamber; the two symmetrical shoulder passages can provide the decanter with a convection passage to facilitate filling a liquor into the decanter or decanting a liquor out of the same.

Still another object of the present invention is to provide an improved decanter structure, of which the two symmetrical shoulder passages above the inner chamber are in communication with the neck passage and the inner chamber; one of the symmetrical shoulder passages is used for conveying liquor, while the other shoulder passage is used for convection of air so as to facilitate decanting a liquor.

A further object of the present invention is to provide an improved decanter structure, of which the two symmetrical shoulder passages can prevent a liquor in the decanter from flowing out unintentionally in case of the decanter falling down because of the two shoulder passages being unable to have a convection effect easily.

DETAILED DESCRIPTION OF THE PREFERRED EMBODIMENT

Figure 1:
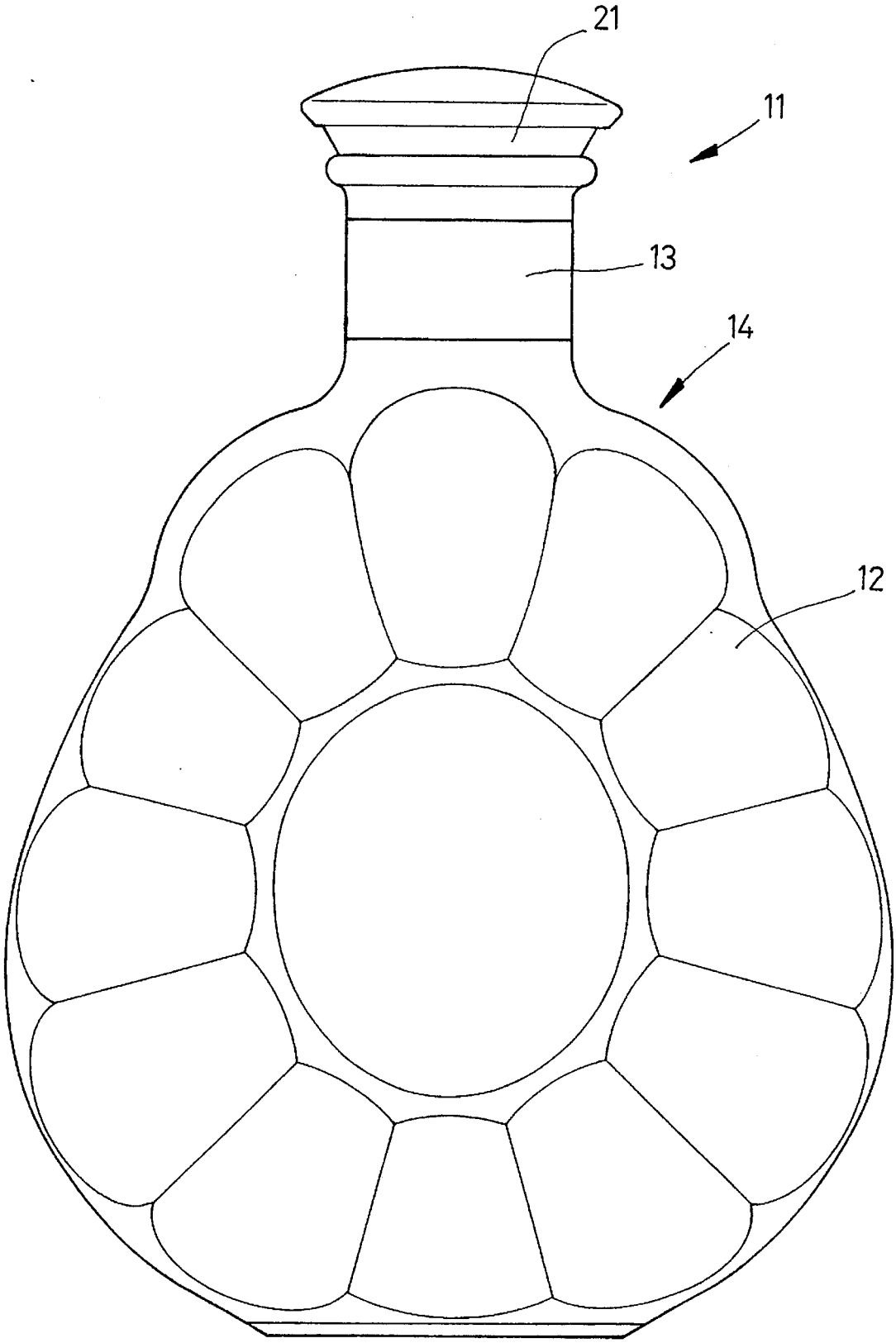
FIG. 1 is a perspective view of the decanter according to the present invention.
Figure 2:
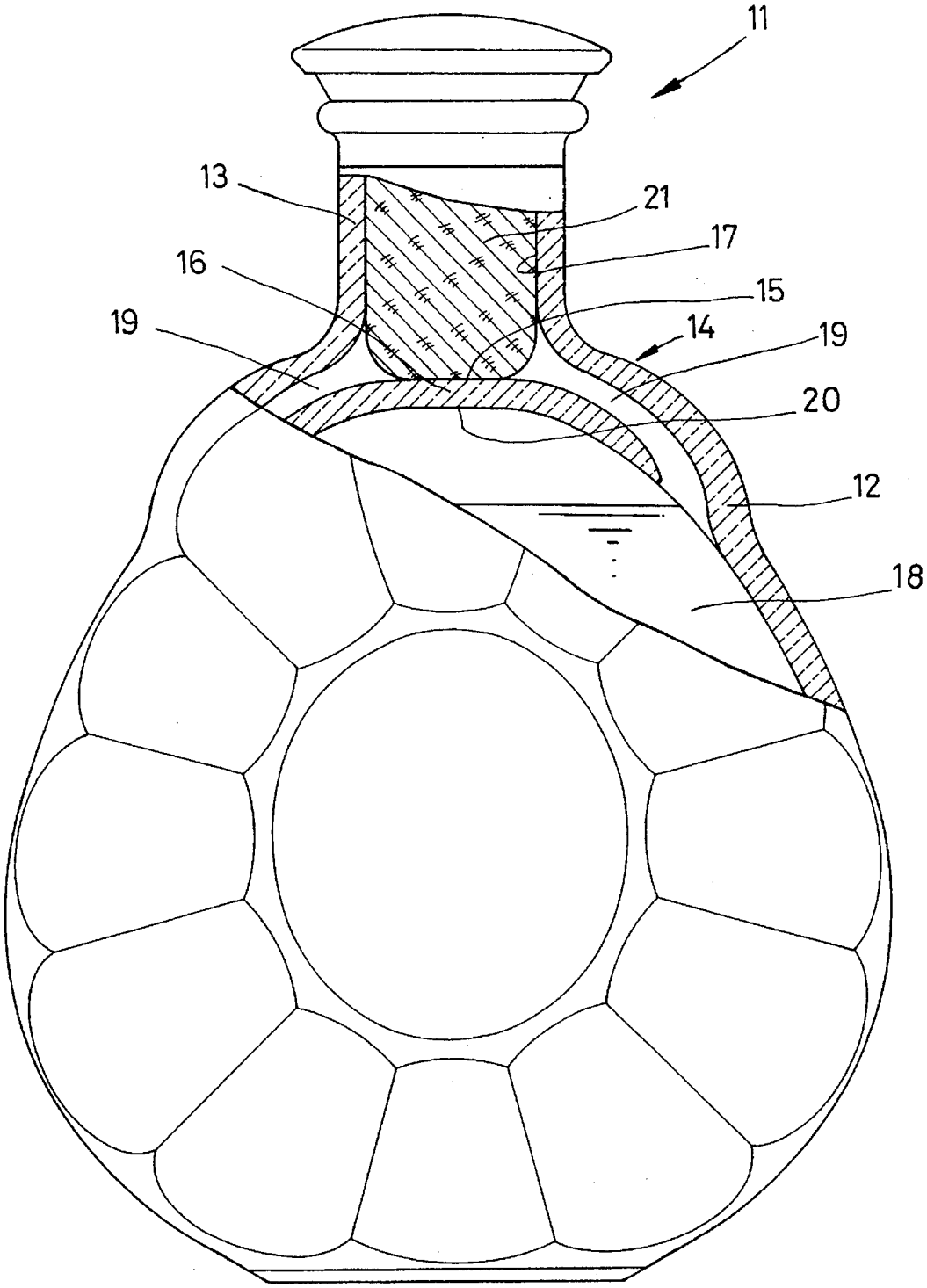
FIG. 2 is a fragmental section view of the decanter, showing the passage in the neck portion thereof with a cork mounted in place.
Figure 3:
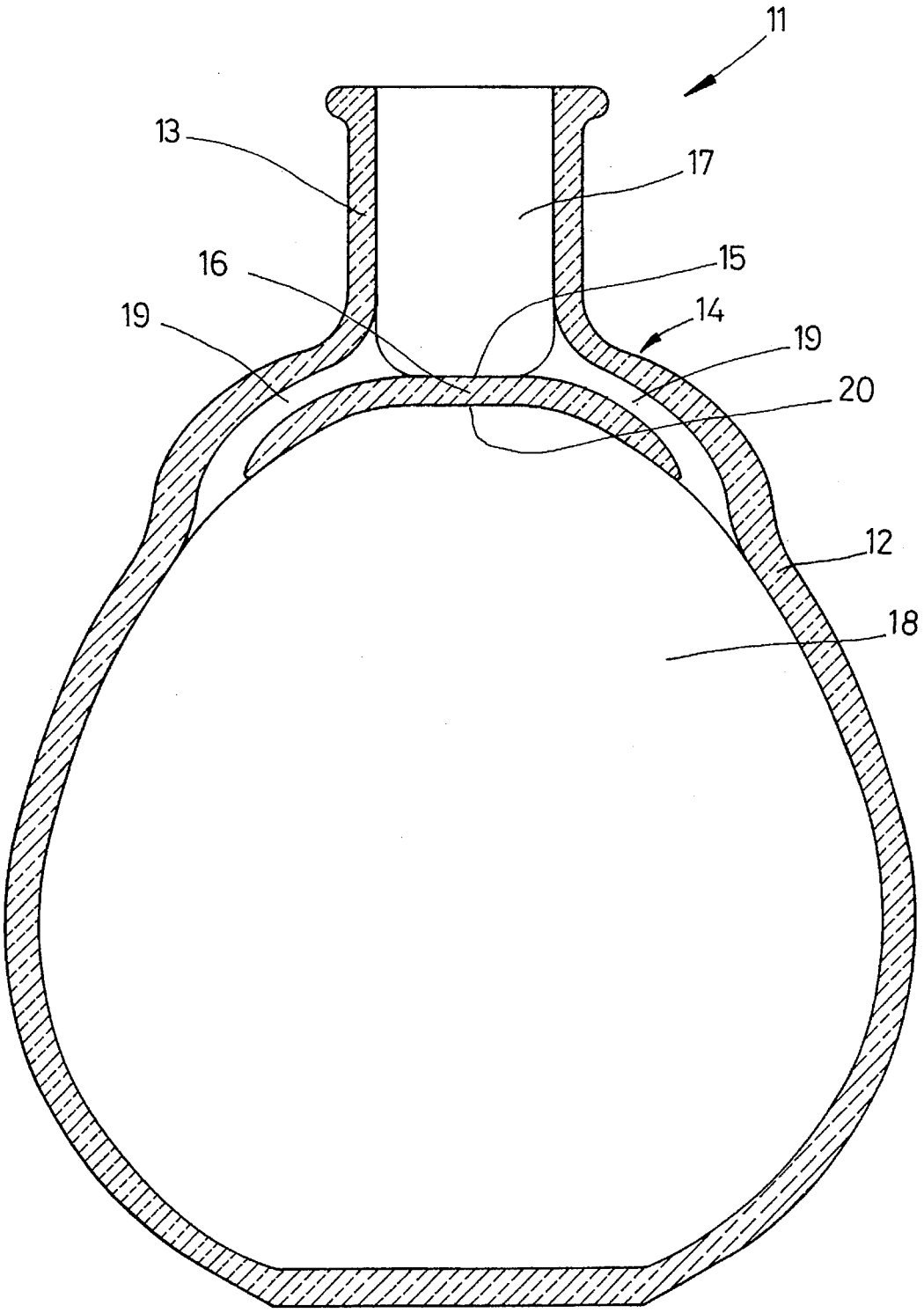
FIG. 3 is another sectional view of the decanter, showing the passages and the inner chamber thereof.
Figure 4:
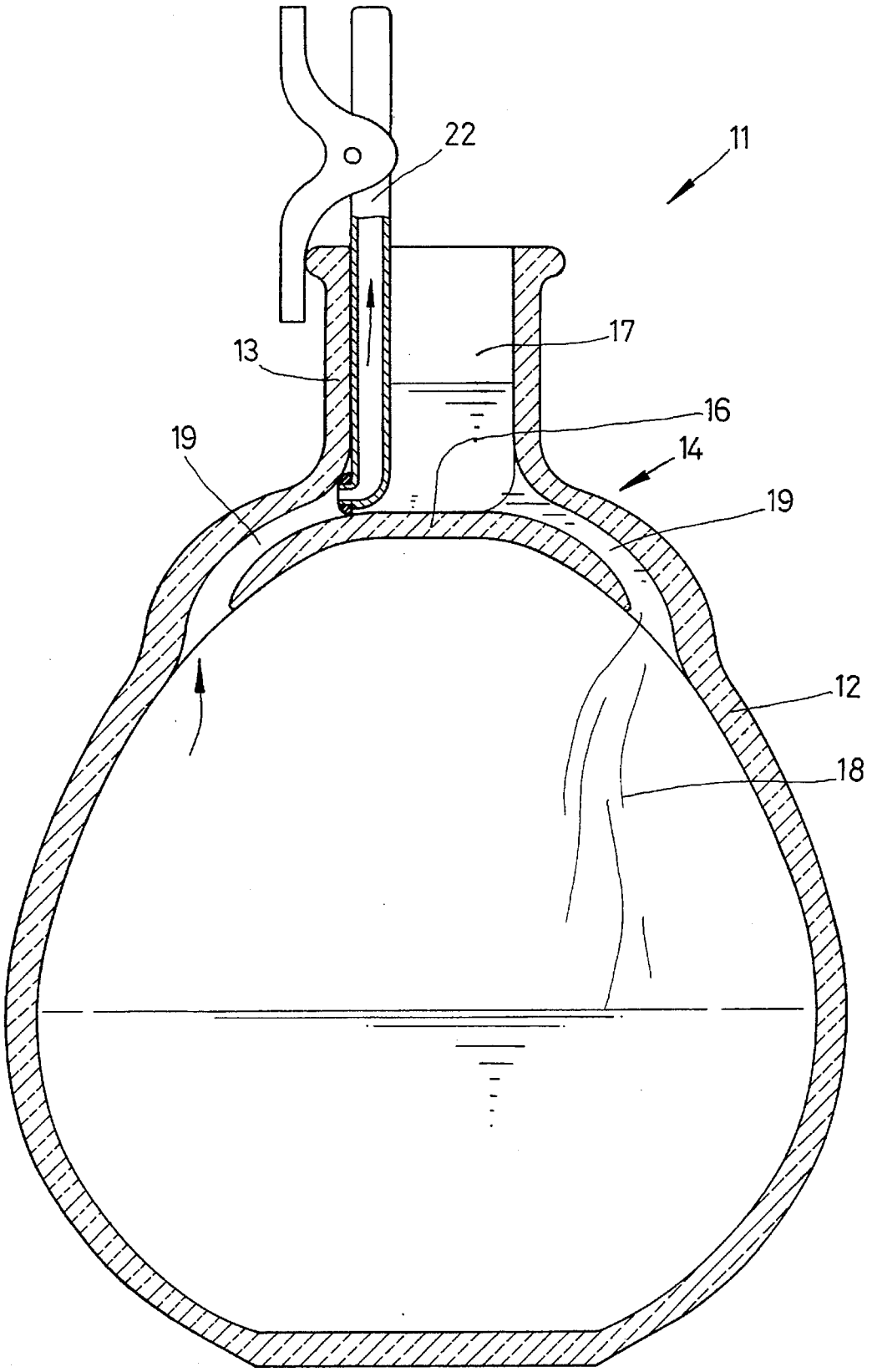
FIG. 4 is still another sectional view of the decanter upon being poured with a liquor or wine.

Referring to FIGS. 1 to 5, the improved decanter structure according to the present invention relates to a decanter 11 being improved to a suitable body portion 12, which includes an inner chamber 18 and a neck passage 17 to be plugged with a cork 21. After the inner chamber 18 is filled with a liquor, a cork 21 is plugged up in the neck passage 17 to seal the liquor therein tightly for storage.

The inside of the neck passage 17 is furnished with a partition plate 16, which is located between the upper edge of the inner chamber 18 and the neck passage 17 so as to divide the body portion 12 into two parts, i.e., the inner chamber 18 and the neck passage 17. The body portion 12 has two thicker parts, i.e., the two shoulder portions 14. From the top surface 15 of the partition plate 16 to the two shoulder portions 14, there are furnished two shoulder passages 19 respectively and symmetrically; the shoulder passages 19 extend from the neck passage 17 above the top surface 15 of the partition plate 16 to the inner chamber 18; the two shoulder passages 19 are connected each other on the top surface 15 of the partition plate 16. The partition plate 16 provides a blockade effect between the inner chamber 18 and the neck passage 17. The two shoulder passages 19 in the shoulder portions 14 will be used for filling in or decanting a liquor in a convection effect.

The partition plate 16 at the bottom of the neck passage 17 is furnished in the thicker part of the shoulder portion 14 so as to form two symmetrical shoulder passages 19 on the two shoulders of the decanter 11. To fill a liquor into the decanter through the shoulder passage 19, the liquor will be unable to fir directly therein because of the partition plate 16; in other words, a convection passage has to be provided in advance for filling. When an automatic pouring machine is used for the filling, the pouring machine must be provided with a filling tube and a vacuum pumping apparatus; the filling tube is to be connected with one shoulder passage 19, while the tube of the vacuum pumping apparatus is connected with the other shoulder passage 19; the air in the inner chamber 18 will be pumped out with the vacuum pumping apparatus so as to have a liquor entered the inner chamber 18 through a shoulder passage 19. When the decanter is fired manually, the upper end of one shoulder passage 19 of the neck passage 17 is mounted with an air-exhausting clip 22 so as to have the air in the inner chamber 18 exhausted; in that case, a large space above the partition plate 16 still exists to facilitate filling a liquor through the other shoulder passage 19 to flow into the inner chamber 18.

Figure 5:
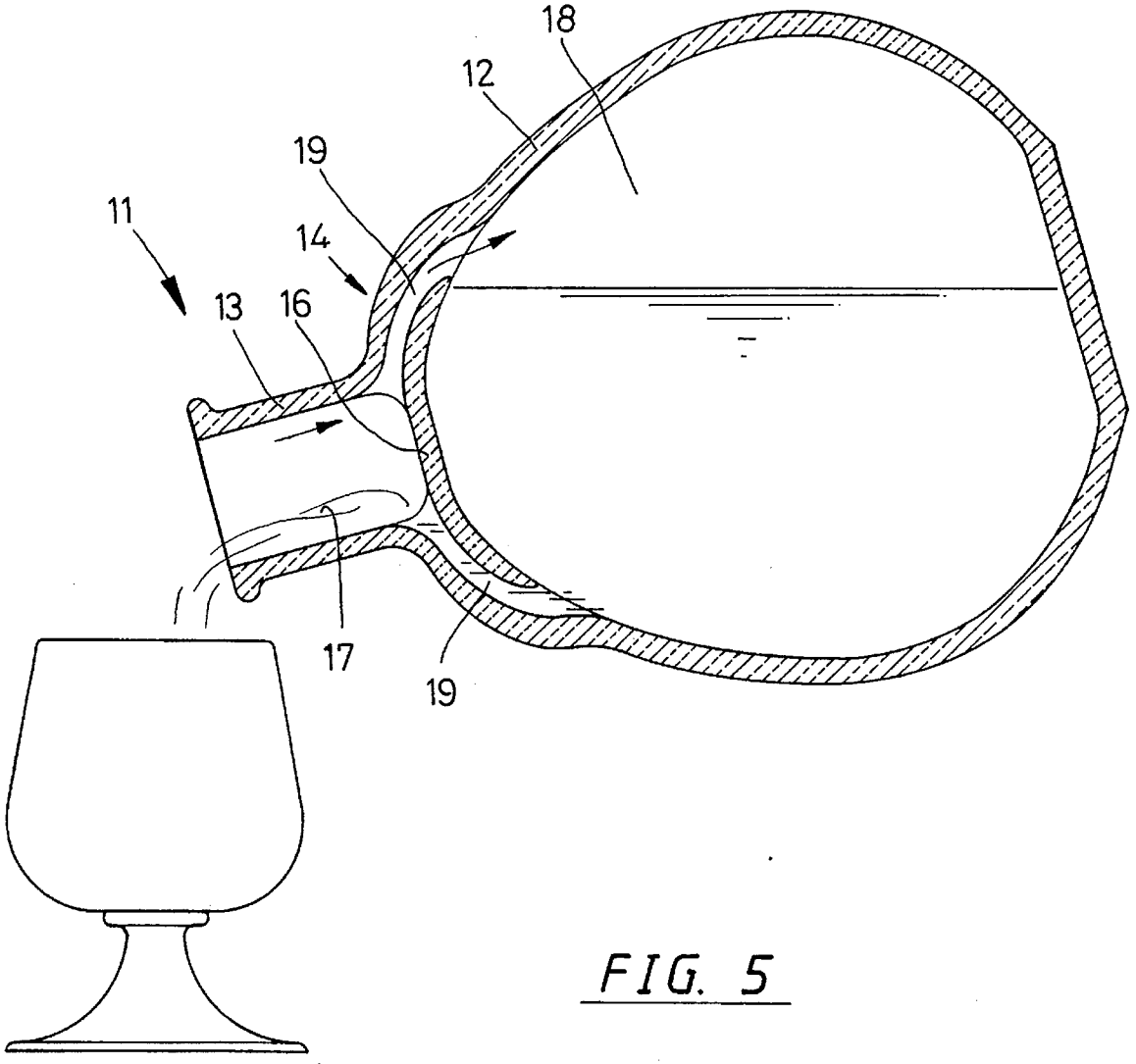
FIG. 5 is a further sectional view of the decanter upon decanting a liquor or wine out.

As soon as the cork 21 is pulled out, a liquor in the inner chamber 18 can only flow out through the two shoulder passages 19 as a result of the partition plate 16; when decanting a liquor out as shown in FIG. 5, the decanter 11 will be set at a proper angle to have the liquor flow limited by means of the shoulder passages 19. In case of a decanter falling down, the liquor therein would not flow out because of no convention effect taking place.

Figure 6:
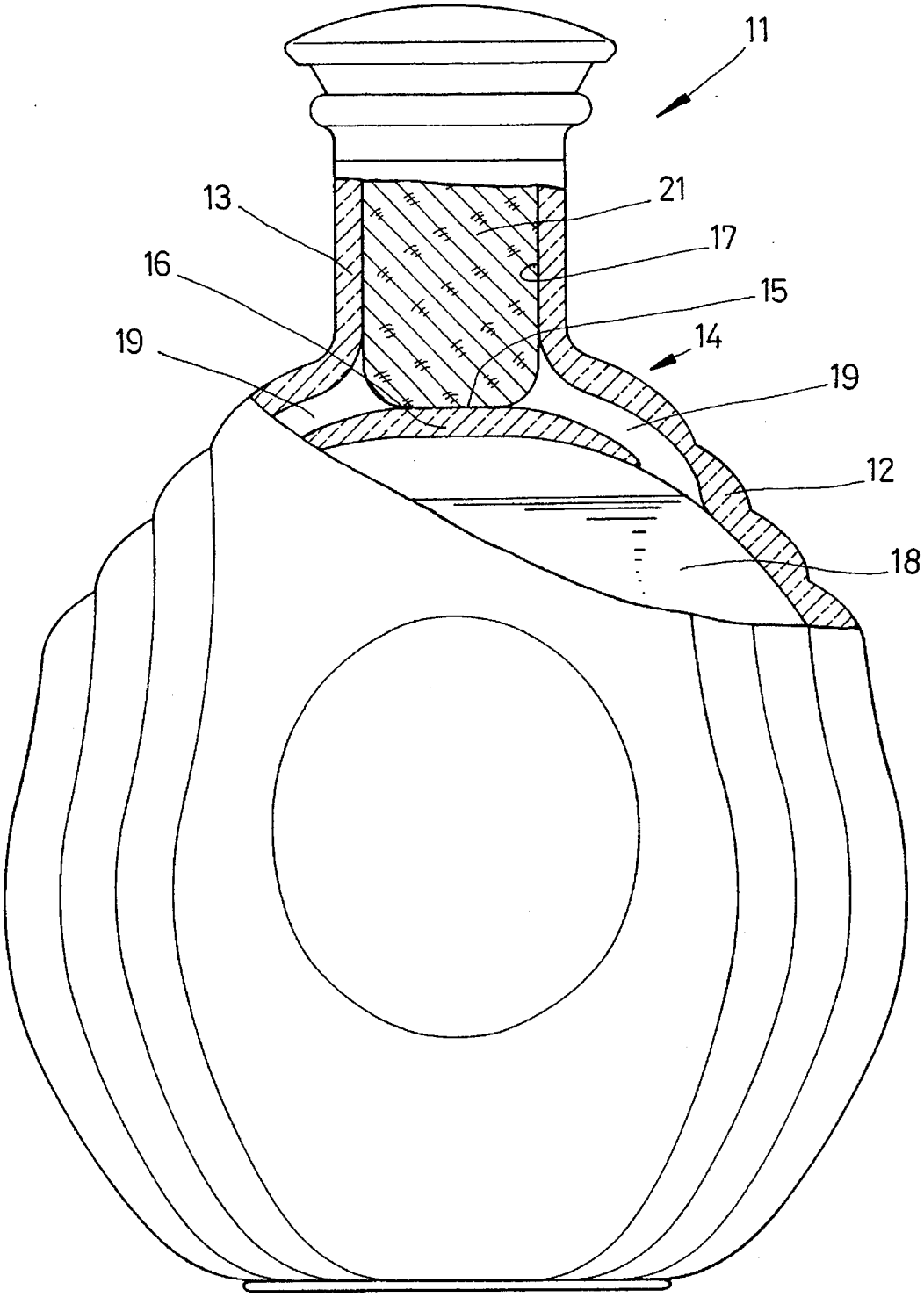
FIG. 6 is a fragmental section view of another embodiment according to the present invention.

The prime feature of the decanter 11 according to the present invention is the stopper structure in the shoulder portion 14 under the neck portion 13. The form of the body portion 12 may be modified properly as shown in FIG. 6, which is another embodiment of the present invention. Under the neck passage 17 of the decanter 11, there is furnished with a partition plate 16, of which two sides are provided with two symmetrical shoulder passages 19 so as to provide a buffer effect to limit the flow of liquor out of the decanter.

The present invention has been described fully by means of the aforesaid embodiments on the features and structure thereof. It is apparent that the present invention has a prominent improvement to the conventional decanter, and such features are never anticipated and shown by any one; therefore, it is deemed an unique structure.

I claim:

1. An improved decanter structure comprising a body portion having an inner chamber, a neck portion extending from the body portion and having a neck passage and a partition plate located between said inner chamber and said neck passage dividing said decanter into said inner chamber and said neck portion: shoulder portions formed on the body portion under said neck portion provided with two symmetrical shoulder passages in communication with said neck passage and said inner chamber, said two symmetrical shoulder passages forming symmetrical passages to facilitate filling a liquor into said decanter or decanting a liquor out of said decanter.

* * * * *